US006801628B1

(12) United States Patent
Thiel

(10) Patent No.: US 6,801,628 B1
(45) Date of Patent: Oct. 5, 2004

(54) SYSTEM AND METHOD FOR ADJUSTING FREQUENCY RESPONSE CHARACTERISTICS OF A SPEAKER BASED UPON PLACEMENT NEAR A WALL OR OTHER ACOUSTICALLY-REFLECTIVE SURFACE

(75) Inventor: James Thiel, Lexington, KY (US)

(73) Assignee: Thiel Audio Products, Lexington, KY (US)

( * ) Notice: Subject to any disclaimer, the term of this patent is extended or adjusted under 35 U.S.C. 154(b) by 256 days.

(21) Appl. No.: 09/855,138

(22) Filed: May 14, 2001

Related U.S. Application Data

(60) Provisional application No. 60/207,803, filed on May 30, 2000.

(51) Int. Cl.[7] ..... H04R 29/00
(52) U.S. Cl. ..... 381/56; 381/58
(58) Field of Search ..... 381/56, 17, 61, 381/160, 305, 11, 58, 81, 172, 304

(56) References Cited

U.S. PATENT DOCUMENTS 5,818,949 A * 10/1998 Deremer ..... 382/172
6,169,806 B1 * 1/2001 Kimura et al. ..... 381/17
6,479,742 B1 * 11/2002 Torii ..... 381/58

* cited by examiner

*Primary Examiner*—Minsun Oh Harvey
(74) *Attorney, Agent, or Firm*—Thomas, Kayden, Horstemeyer & Risley

(57) ABSTRACT

The present invention is directed to a speaker system that more accurately reproduces audio sounds by minimizing the negative effects from sound reflecting from a nearby wall. The invention is embodied in both methods and apparatus of differing forms. In one embodiment, the invention comprises a method that receives an electrical signal embodying an audio signal to be communicated to the speaker, and modifies the electrical signal by a measure that is based upon a separation distance separating the speaker and a wall. In another embodiment, the invention comprises a driver circuit for a an audio amplifier that, in turn, drives a speaker. The driver circuit includes a circuit configured to receive an electrical signal embodying an audio signal to be communicated to the speaker, and a signal modifying circuit configured to modify the electrical signal by a measure that is based upon a separation distance separating the speaker and a wall.

34 Claims, 7 Drawing Sheets

SYSTEM AND METHOD FOR ADJUSTING FREQUENCY RESPONSE CHARACTERISTICS OF A SPEAKER BASED UPON PLACEMENT NEAR A WALL OR OTHER ACOUSTICALLY-REFLECTIVE SURFACE

CROSS-REFERENCE TO RELATED APPLICATIONS

This application claims the benefit of U.S. Provisional Patent Application Serial No. 60/207,803, filed on May 30, 2000, which is incorporated herein by reference in its entirety.

FIELD OF INVENTION

This invention is generally related to loudspeakers, and more particularly to a system and method for modifying frequency response characteristics of a loudspeaker that is placed near a wall or other acoustically-reflective surface.

BACKGROUND

As is well known, a loudspeaker receives an electrical signal representing an audio sound and converts the electrical signal to an audio sound wave via a loudspeaker driver unit. The driver unit usually comprises an electro-magnetic motor which responds to an electrical signal to move a diaphragm. The frequencies and nature of the electrical signal control the frequencies and nature of the audio signal. Other types of driver units are available and commonly known in the art.

The loudspeaker typically comprises a driver unit and an enclosure. The driver unit acts as set forth above to generate the audio wave. The enclosure acts to suspend the driver unit as desired and contain the sound wave generated by the driver unit on the rear side.

The quality of the audio reproduction by an individual loudspeaker is influenced by the interaction of the produced audio waves and the nearby boundary surfaces such as walls. The loudspeaker performance is particularly influenced by the interaction between the produced audio waves and nearby walls. A reduction in loudspeaker performance quality occurs because sonic reflections from the nearby walls interfere with sonic waves emanating from the loudspeaker, often causing a series of frequencies to be partially cancelled and another series of frequencies to be partially reinforced. The first frequency of each series is affected the most severely and has the most substantial negative effects on the performance of the loudspeaker. Primary partial cancellation occurs when the central axis of the driver unit is spaced from the flat surface a distance that is equal to ¼ wavelength of the audio wave so that the reflected audio wave is delayed approximately ½ wavelength or "out of phase"when it returns to the location of the diaphragm. Primary partial reinforcement occurs when the driver unit is spaced from the reflecting surface a distance that is equal to ½ wavelength of the audio wave. Then, the reflected audio wave is approximately 1 wavelength delayed, or "in phase" when it returns to the location of the diaphragm.

Since the velocity of audio waves in air is approximately 345 meters/second, the frequency at which the original audio wave will be canceled, $F_c$, is equal to 86/D, where D is the distance between the nearby wall and the driver unit center (measured in meters). The frequency at which the original audio wave will be reinforced, $F_r$, is equal to 172/D. As the distance D decreases, the higher the cancellation frequency and the reinforcing frequency become. For example, if the loudspeaker diaphragm to wall distance is 17 cm, then the frequency range of partial cancellation will be centered at approximately 500 Hz, and the frequency range of the reinforcement will be centered at approximately 1 kHz.

Of course, as the separation distance between a speaker and a wall (or other reflective surface) increases, the affect of the reflective interference is reduced, due to the amplitude attenuation of the sound wave. However, as speakers are placed in close proximity to a wall or other sound reflective surface (as they often are), then the deleterious impact may become more noticeable.

As is known, many loudspeakers are engineered to exhibit a frequency response that has desired characteristics when placed in a room at a significant distance from room walls. If such a loudspeaker is placed in close proximity to a wall, or two walls in the case of placement near a corner of the room, the frequency response, as measured by the sound pressure level produced at a distance from the speaker, will change from that produced when positioned farther from the wall.

The frequency response changes at lower frequencies (below approximately 300 Hertz) are mainly due to two effects. The first effect is that the wall tends to confine the radiation from the loudspeaker to a smaller solid angle and therefore to increase the sonic pressure produced by the loudspeaker below a certain frequency. The second effect is that sonic reflection from the wall causes partial cancellation of some frequencies. The degree of both these effects, and the frequencies affected by the second effect are dependent on the speaker's distance from the wall.

In view of the foregoing, it is desired to provide an audio system that has improved performance when speakers are positioned near a wall or other acoustically-reflective surface.

SUMMARY OF INVENTION

The present invention is directed to a speaker system that more accurately reproduces audio sounds by minimizing the negative effects from sound reflecting from a nearby wall. The invention is embodied in both methods and apparatus of differing forms. In one embodiment, the invention comprises a method that receives an electrical signal embodying an audio signal to be communicated to the speaker, and modifies the electrical signal by a measure that is based upon a separation distance separating the speaker and a wall. In another embodiment, the invention comprises a driver circuit for a an audio amplifier that, in turn, drives a speaker. The driver circuit includes a receiver configured to receive an electrical signal embodying an audio signal to be communicated to the speaker, and a signal modifying circuit configured to modify the electrical signal by a measure that is based upon a separation distance separating the speaker and a wall.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION OF PREFERRED EMBODIMENT

Figure 1:
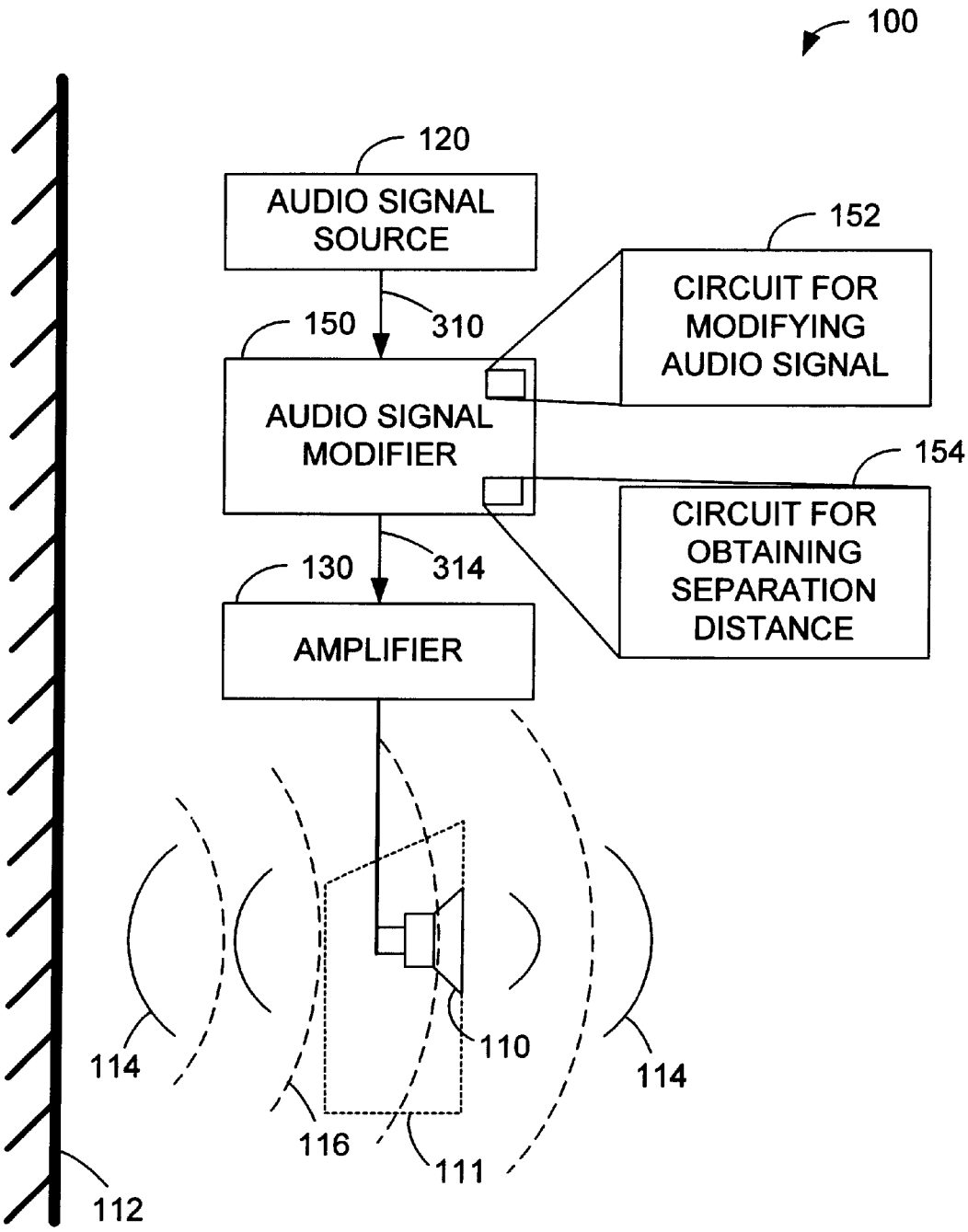
FIG. 1 is diagram illustrating the fundamental components in a system constructed in accordance with the present invention.

Having summarized various aspects of the present invention, reference will now be made in detail to the description of the invention as illustrated in the drawings. While the invention will be described in connection with these drawings, there is no intent to limit it to the embodiment or embodiments disclosed therein. On the contrary, the intent is to cover all alternatives, modifications and equivalents included within the spirit and scope of the invention as defined by the appended claims.

Reference is now made to FIG. 1, which is a block diagram of a system 100 constructed in accordance with the present invention. As summarized above, the present invention is directed a system for modifying an electrical audio signal that is to be delivered to a speaker 110, such that the electrical audio signal is modified to account for distortion and interference that occur from sonic reflections due to speaker placement in proximity to a wall 112 or other acoustically-reflective surface. In this regard, the diagram of FIG. 1 illustrates a speaker 110 that generates sound waves 114. As is known, the sound waves emanate radially from the speaker 110. If, however, the speaker 110 is placed near a wall 112, reflections 116 of the sound wave will typically occur. Of course, the magnitude of the reflective waves will depend upon the material and other characteristics of the wall 112, distance, and other factors. For purposes of illustration, reflective waves 116 are illustrated by dash line. Further, it should be understood that the speaker 110 (with a cabinet 111 illustrated in dashed line) is shown generically only to illustrated the concept of the audio wave propagation and reflection, and the speaker and cabinet in FIG. 1 are not intended to represent an actual, physical implementation.

As is known, conventional audio systems include an audio signal source 120 and an amplifier 130. As is known, the audio signal source 120 may include components like CD players, tape players, etc. As is known, the audio signal source 120 generates an electrical signal embodying audio that is to be generated and emanated from a speaker 110. The signal generated by the audio signal source 120 is generally a low voltage signal that is passed through an amplifier 130 for appropriate audio amplification and filtering. Since the structure and operation of audio receivers and amplifiers are well known, these components need not be described herein.

Instead, the present invention is directed to a novel device and method for modifying such an electrical audio signal. In this regard, the device 150 is denoted in FIG. 1 as "audio signal modifier." In the preferred embodiment, the audio signal modifier 150 includes circuitry for performing a number of functions, such as temperature compensation, as well as the inventive aspect of modifying the electrical audio signal based upon the proximity of placement of the speaker 110 to a nearby wall 112 or other acoustically-reflective surface. To this end, the audio signal modifier 150 includes a circuit 152 that is configured to modify the audio signal in accordance with a distance, separating the speaker 110 from a nearby wall 112 (referred to herein as "separation distance"). This circuit 152 is defined by a frequency response (i.e., transfer function) that is substantially the inverse of the change or alteration in the speaker's frequency response due to the placement of a speaker near a wall or other acoustically-reflective surface. As should be appreciated by persons skilled in the art, this transfer function may vary in dependence upon a number of factors, principally including factors relating to the acoustic reflectivity of the wall 112. Therefore, depending upon the environment that the audio system 100 is designed for, the design of the circuit 152 may vary among different embodiments. Accordingly, the particular embodiment that will be described hereinafter should be understood to be only one example of a variety of specific implementations of the present invention.

In addition to the circuit 152 for modifying the audio signal 310, the audio signal modifier 150 also includes a circuit 154 for obtaining the separation distance (i.e., the distance separating the speaker 110 from the wall 112). In a preferred embodiment, this circuit includes a user interface that allows a user to manually enter the distance separating the speaker 110 from the wall. Of course, in such an embodiment it is contemplated that the user will take physical measurements measuring the distance from the wall to the center of the driver of the speaker. Consequently, if the speaker cabinet was three feet deep, the rear of the cabinet could be placed adjacent to the wall 112, and the separation distance would be approximately three feet. In another embodiment, the circuit 154 may include circuitry for automatically detecting and obtaining the distance between the driver and the wall 112. There are many known mechanisms for obtaining such a distance measurement. For example, such distance measuring circuits are embedded into autofocus mechanisms of cameras, in order to effectively measure distance and automatically adjust the focus of a camera lens. This circuit may be implemented using infrared, ultrasonic, or other technologies in which a signal may be emitted and its reflection timed and measured in order to compute distance. Although the circuit 154 has been illustrated in FIG. 1 as being a part of the audio signal modifier 150, it will be appreciated that transducer elements of such a circuit configured to automatically detect the separation distance, would likely be disposed within the speaker cabinet itself. For purposes of the broader concepts and teachings of the present invention, the obtainment of the distance between the speaker driver and the wall 112, are not significant. Instead, the broader concepts of the invention are directed to the signal compensation or modification based upon the obtained separation distance.

FIG. 1 illustrates the placement of a speaker 110 in proximity to a rear wall 112. It should be appreciated, however, that the concepts of the present invention are not limited to this configuration. Indeed, the present invention may be employed to compensate for reflections or interference due to sidewalls, or even both rear wall and sidewall disturbances. In this regard, and as should be understood by persons skilled in the art, the direction that the speaker 110 is pointing does not effect its response at low frequencies, as the speaker is treated as omni-directional in low frequency operation. Thus, for example, if the speaker 110 was placed three feet from both a sidewall and a rear wall, the impact of each wall would be substantially the same. For simplicity, the circuitry illustrated herein is directed to an embodiment compensating for the reflections of only a single wall. However, it should be appreciated by persons skilled in the art that this embodiment may be readily extended to account for multiple reflective surfaces.

Figure 2:
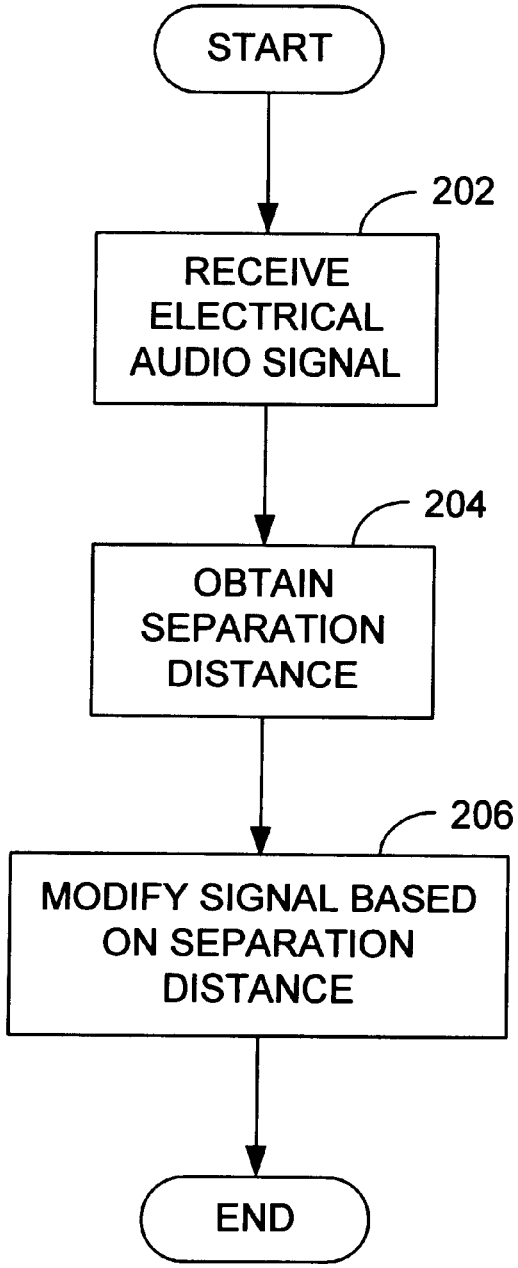
FIG. 2 is a flow chart illustrating the top-level operation of a method constructed in accordance with the invention.

Reference is now made to FIG. 2, which is a flow chart illustrating the top-level operation of a method operating in accordance with the present invention. In this regard, the method operates to modify an electrical audio signal to compensate for distortions or interferences due to reflections from a nearby wall. In accordance with this aspect of the invention, the method operates to receive the electrical signal (step 202), obtain a separation distance, defined as the distance between the center of the speaker driver and a nearby wall (step 204), and modify the electrical signal based upon the separation distance (step 206). As mentioned above, the step of modifying the signal operates to essentially modify the signal in accordance with a frequency response that is substantially the inverse of the changes in the speaker's frequency response due to placement of the speaker near a wall. Again, depending upon a number of characteristics, including the reflectivity characteristics of the wall, the equation (i.e., transfer function) defining this frequency response may vary.

Figure 3:
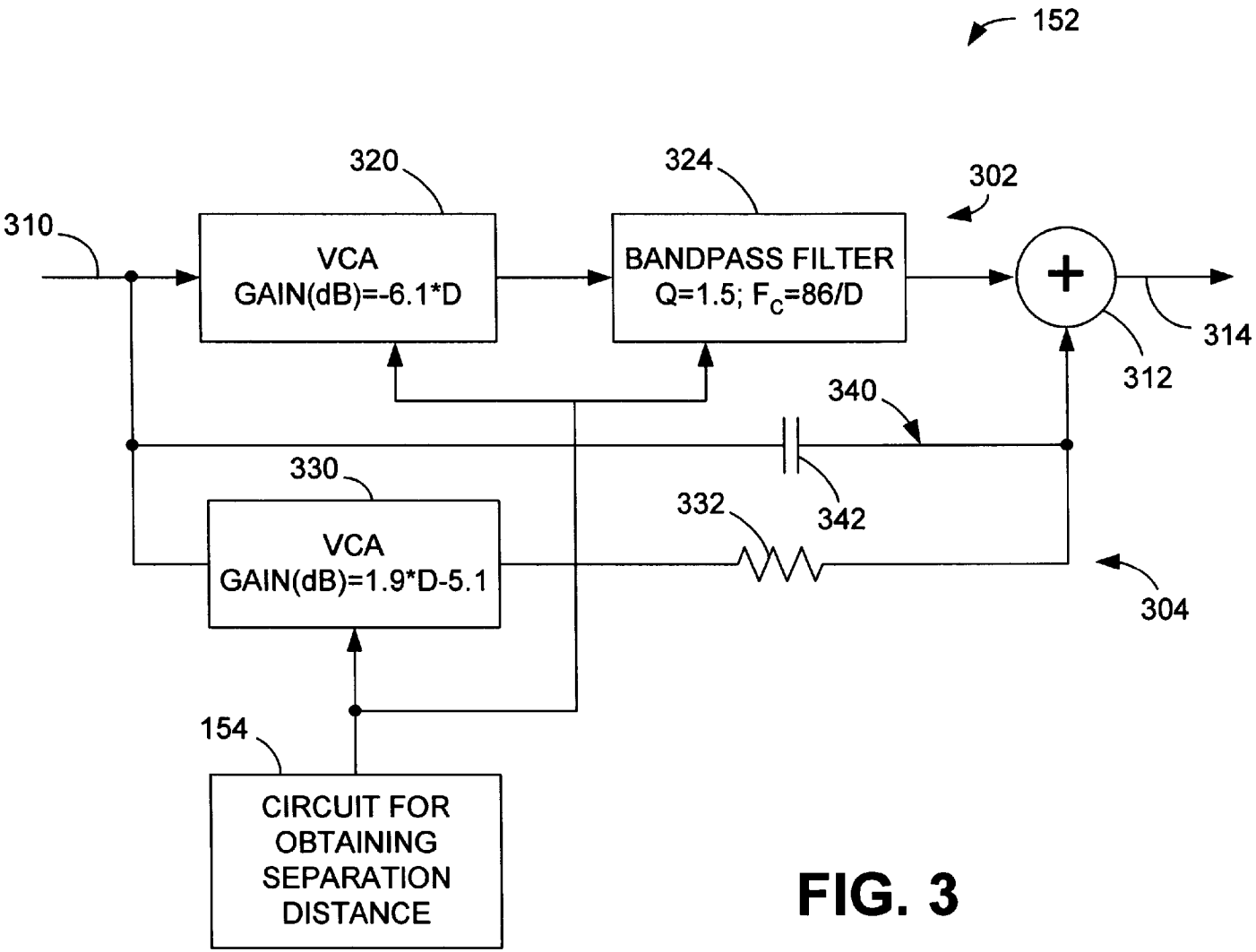
FIG. 3 is a block diagram of a circuit configured to modify an electrical audio signal, constructed in accordance with one embodiment of the invention.

Having provided a top-level description of a system and method of the present invention, reference is now made to FIG. 3, which is a block diagram illustrating one embodiment of a circuit 152 for modifying an audio signal in accordance with the teachings of the invention. In this implementation, the circuit 152 may comprise two separate, substantially parallel paths 302 and 304. Each path 302, 304 receives the electrical audio signal 310 at its input. At their outputs, however, the two separate paths 302 and 304 are summed by a summer circuit 312, to generate an output signal 314 to be directed to an amplifier 130.

More specifically, the first path 302 may include a voltage controlled amplifier 320 that is defined by a gain equal to −6.2*D dB, where D equals the separation distance between the center of the speaker driver and the wall. This amplifier 320 is connected in series with a bandpass filter having a center frequency substantially equal to 86/D, and a Q equal to 1.5. As will be understood by persons skilled in the art, Q represents the "quality factor" of a resonance. The higher the Q, the more strongly the resonant frequency is amplified and the more narrow is the range of frequencies that will be amplified by the resonance. In the preferred embodiment, the bandpass filter may be a second order bandpass filter. As will be further understood by persons skilled in the art, the center frequency will usually vary slightly from the theoretical 86/D, depending upon environmental conditions. Using practical numbers, this center frequency may range from 60/D to 100/D. Indeed, in the preferred embodiment of the present invention, the center frequency is 79/D.

As illustrated, the amplifier 320 and bandpass filter 324 each receive a signal 326 that is representative of the separation distance. As illustrated, this signal is derived from the circuit 154 for obtaining the separation distance. As described in connection with FIG. 1, this circuit may take on any of a variety of forms, including a user interface, which allows a user to manually input the separation distance, as well as a circuit for automatically obtaining the separation distance between the driver and the wall.

The second path 304 may similarly include a voltage-controlled amplifier 330. The amplifier 330 of the illustrated embodiment is defined by a gain equal to 1.9*D−5.1 dB. The output of this amplifier 330, is directed through a resistor 332 to a second input of the summer circuit 312. In low frequency operation, the circuit 152 is operative to modify the input signal 310 through the amplifiers 320 and 330 of both the first path 302 and second path 304 (as well as the bandpass filter 324 of the first path). Then, the outputs of the two paths 302 and 304 are added together by summer of 312 to produce the output signal 314.

In the preferred embodiment, an additional path 340 is also provided. The purpose of this additional path is to provide a frequency cut off for the operation of the second path 304, for higher frequency operation. Specifically, when the electrical audio signal 310 is at higher frequencies, then the additional path 340 essentially provides a short circuit of the electrical audio signal 310 to the second input of the summer 312. Such an additional path 340 may be realized by a capacitor 342 having an appropriately selected value such that the capacitor appears as a short circuit for operating frequencies above a predetermined frequency. In the preferred embodiment, the capacitor 342 is selected to operate effectively as a short circuit for frequencies above 300 Hz.

Again, it should be appreciated that the diagram illustrated in FIG. 3, with the particular numerical values denoted and described herein, is intended to implement only one embodiment of the invention. That is, the circuit and values illustrated in FIG. 3 are effective to implement a circuit 152 having a transfer function or a frequency response that is appropriate for certain environmental conditions. However, for differing environments, it may be desirable to implement a similar circuit having differing component values, or even a different circuit all together.

Figure 4A:
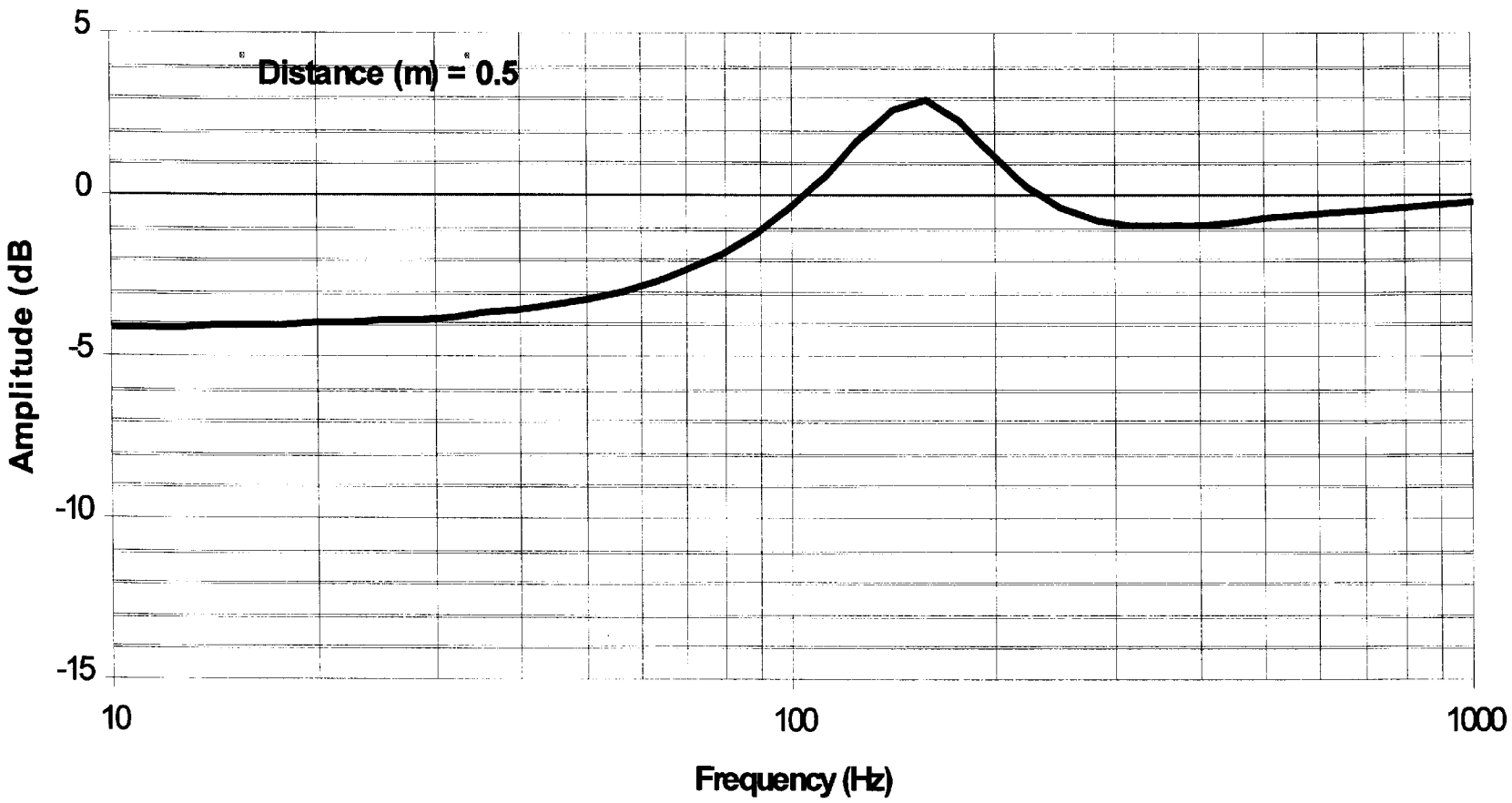
FIGS. 4A–4C are frequency response diagrams of the correction required to compensate for the alteration of the response of a speaker placed 0.5 meters, 1.0 meters, and 1.5 meters, away from a wall.
Figure 4B:
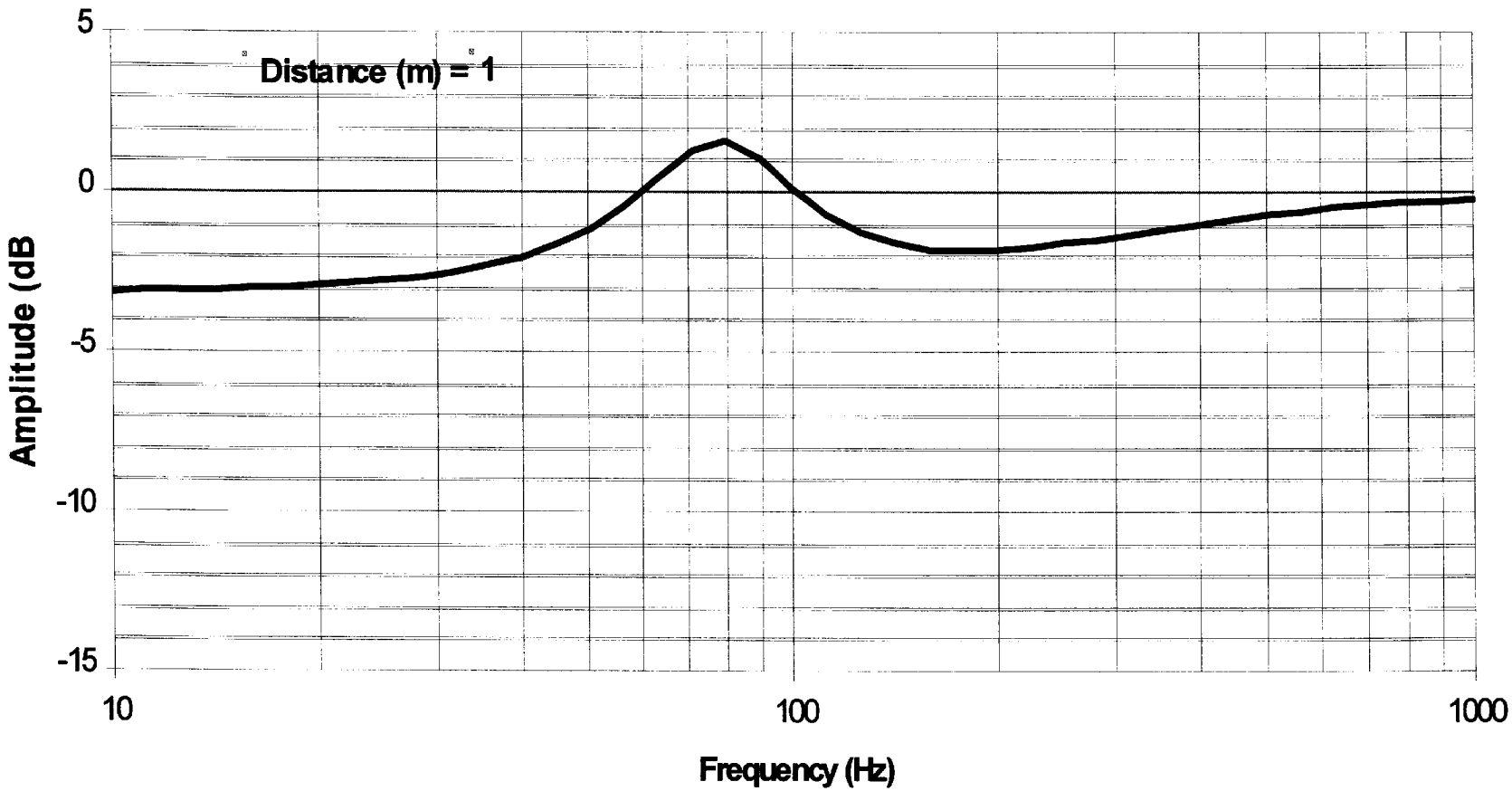
Figure 4C:
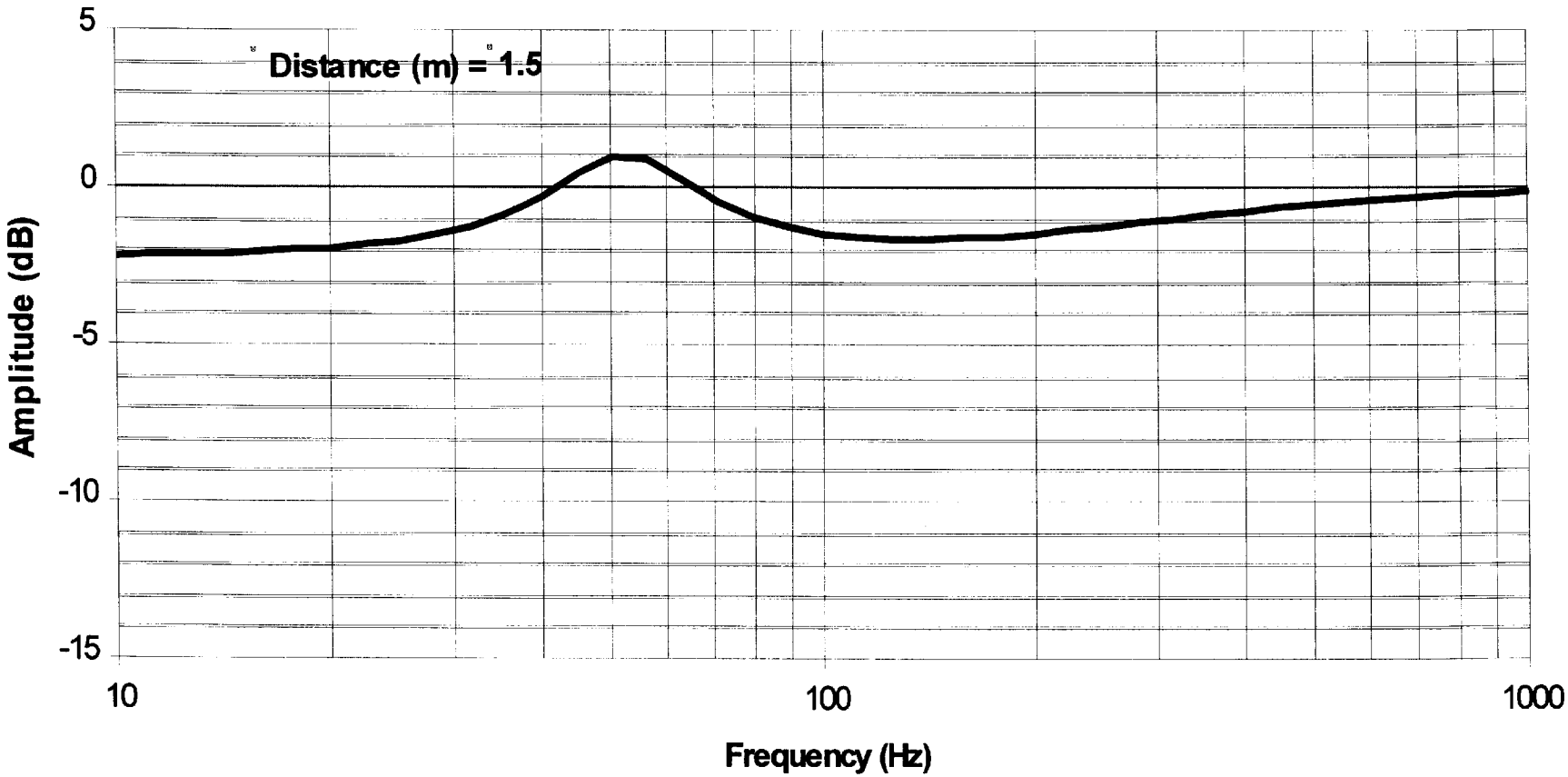

Reference is now made briefly to FIGS. 4A, 4B, and 4C, which are diagrams that graph the frequency response of the circuit illustrated in FIG. 3 with differing values of D. Specifically, FIG. 4A illustrates the frequency response of this circuit with D=0.5 meters. FIG. 4B illustrates the frequency response of the circuit 152 where the separation distance D=1.0 meters. Finally, the graph of FIG. 4C illustrates the frequency response of the circuit 152 where the separation distance D=1.5 meters. As observed, the amplitude peaks at lower frequencies, as the distance to the wall increases.

Figure 5:
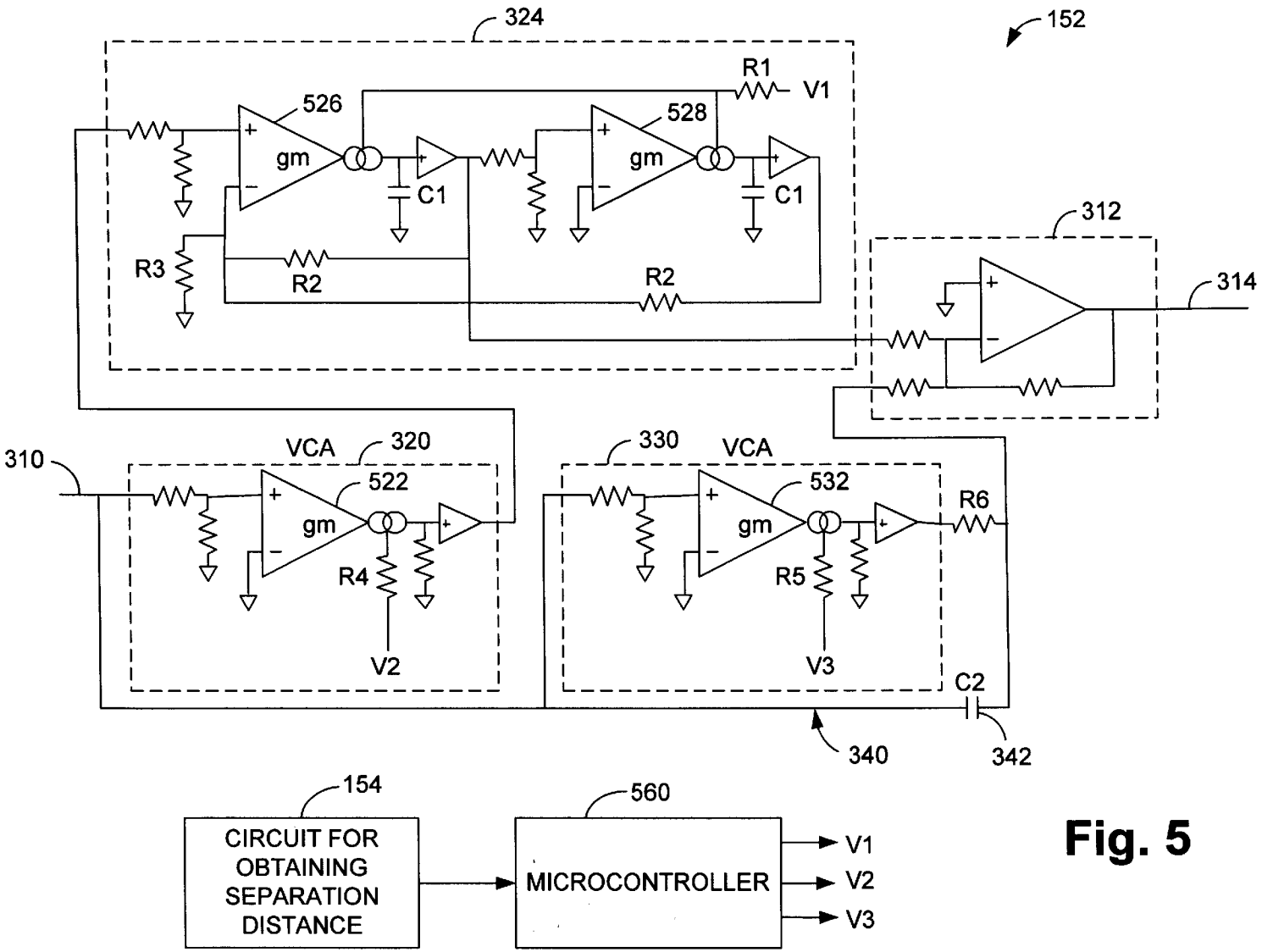
FIG. 5 is a circuit schematic of one possible implementation of a circuit for carrying out the signal modifying circuit of the present invention.

Reference is now made to FIG. 5, which is a circuit diagram that illustrates one possible implementation of the circuit 152 that was more broadly depicted in the block diagram of FIG. 3. In the drawing, like reference numerals have been used to reference the corresponding components depicted in FIG. 3. For example, the electrical audio signal 310 is input to both voltage-controlled amplifiers 320 and 330. As illustrated, the voltage-controlled amplifier 320 is implemented through a combination of electrical components, including a transconductance amplifier 522 and the resister R4. As is known, a transconductance amplifier is a unique type of operational amplifier that offers numerous distinctive capabilities to a circuit designer. Generally, it has all the generic characteristics of a classical operational voltage amplifier, except that the forward transfer characteristic is best described by transconductance rather than voltage gain. The output of a transconductance amplifier is a current, the magnitude of which is equal to the product of the transconductance and the input voltage. The output circuit of this amplifier, therefore, may be characterized by an infinite impedance current generator, rather than the zero-impedance voltage generator used to represent the output circuit of an operational amplifier. The low output conductance of the transconductance amplifier permits the circuit to approach the ideal current generator.

When a transconductance amplifier is terminated in a suitable resistive load impedance and provisions are included for feedback, its performance is essentially identical in all respects to that of a classical operational amplifier. The electrical characteristics of a transconductance amplifier circuit, however, are functions of the amplifier bias current.

Returning to the diagram of FIG. 5, the voltage-controlled amplifier 320 is implemented using a transconductance amplifier 522 having a resistor R4 connected to its bias control input. As shown, this is not a signal input, but rather a bias control which determines the transconductance of the amplifier. A voltage V2 drives the opposite end of resistor R4. Likewise, the voltage-controlled amplifier 330 includes, among other circuit elements, a transconductance amplifier 532. A voltage V3 is connected through a resistor R5 to the bias control input of the transconductance amplifier 532.

The second order bandpass filter 324 is implemented in a slightly more complex circuit that includes a pair of transconductance amplifiers 526 and 528. A voltage V1 is connected through a resistor R1 to the bias control inputs of both transconductance amplifiers 526 and 528. A capacitor C1 is also connected between the output of the transconductance amplifiers 526 and 528 to ground. A resistor R3 is connected between ground and the negative input of transconductance amplifier 526. Additional resistors R2 are also interconnected in the circuitry as illustrated in FIG. 5. Finally, the output of the voltage-controlled amplifier 330 is connected to the summer circuit 312 through a resistor R6. The capacitor 342 mentioned in FIG. 3 as a bypass to the second path, is characterized by a value C2. The interrelationship of the various values of the components V1, V2, V3, R1, R2, R3, R4, R5, R6, C1, and C2 will be described immediately below.

In this example the bandpass filter 324 is implemented as a state-variable type that is implemented with operational transconductance amplifiers so that the characteristic frequency of the filter is controlled by the voltage V1. The voltage controlled amplifiers 320 and 330 are also implemented with operational transconductance amplifiers with their gains controlled by voltages V2 and V3. Specifically, the characteristic frequency of the filter is given by:

$$F = gmV_1R_3/2\pi C_1R_1(R_2+R_3), \qquad \text{Equation 1}$$

where gm is the transconductance per current through R1. And, given that we want F=86/D, where D is the distance from the center of the speaker diaphragm to the wall in meters, then:

$$V_1 = \frac{172\pi C_1R_1(R_2+R_3)}{DgmR_3}. \qquad \text{Equation 2}$$

Typically, the second voltage controlled amplifier 330 is allowed to affect the response of the output only below 300 Hz and this is done by including C2 and R6 and setting their values according to:

$$C_2 = 1/2\pi 300R_6. \qquad \text{Equation 3}$$

The voltage gains of the voltage controlled amplifiers 320 and 330 are directly proportional to their control voltages, V2 and V3 and typically might be:

$$A_v = 1000V_2/R_4. \qquad \text{Equation 4}$$

If so, then to implement the voltage controlled amplifier gains of FIG. 5, the control voltages would be given by:

$$V_2 = \frac{R_4 10^{\left(\frac{-6.2D}{20}\right)}}{1000} \text{ and} \qquad \text{Equation 5}$$

$$V_3 = \frac{R_5 10^{\left(\frac{1.9D-5.1}{20}\right)}}{1000}. \qquad \text{Equation 6}$$

As illustrated, formulas for V1, V2, and V3 may be generated by a microcontroller 560, a microprocessor, or other commensurate device. Specifically, a microcontroller 560 may calculate the desired values of these voltages for any given value of D, and by this means, a user-adjustable voltage, calibrated in distance of the speaker to the wall, inputted into the microcontroller can be used to control all circuitry, as illustrated in FIG. 5.

The foregoing description has been presented for purposes of illustration and description. It is not intended to be exhaustive or to limit the invention to the precise forms disclosed. Obvious modifications or variations are possible in light of the above teachings. The embodiment or embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly and legally entitled.

What is claimed is:

1. A method for improving a quality of sound from a speaker comprising:

receiving an electrical signal embodying an audio signal to be communicated to the speaker; and modifying the electrical signal by a measure that is based upon a separation distance separating the speaker and a wall, the electrical signal being modified by a circuit defined by a transfer function that is substantially an inverse of a change in a frequency response of the speaker due to placement near the wall.

2. The method of claim 1, further including obtaining the separation distance.

3. The method of claim 2, wherein the step of obtaining the separation distance includes utilizing circuitry to automatically obtain the separation distance.

4. The method of claim 2, wherein the step of obtaining the separation distance includes manually entering the separation distance into a user interface.

5. The method of claim 1, wherein the step of modifying the electrical signal more specifically includes passing the electrical signal through two separate paths and summing the output of the two separate paths to generate an output signal.

6. The method of claim 5, wherein the first separate path passes the electrical signal through an amplifier element defined by a gain of −6.2*D dB, where D is equal to the separation distance measured in meters, and then passes the output of the amplifier element through a bandpass filter having a center frequency substantially equal to 86/D.

7. The method of claim 5, wherein the first separate path passes the electrical signal through an amplifier element defined by a gain that varies inversely with D, where D is equal to the separation distance measured in meters, and then passes the output of the amplifier element through a bandpass filter having a center frequency within a range of 60/D to 100/D.

8. The method of claim 5, wherein the second separate path passes the electrical signal through an amplifier element defined by a gain of substantially 1.9*D−5.1 dB, where D is equal to the separation distance measured in meters.

9. The method of claim 5, wherein the second separate path passes the electrical signal through an amplifier element defined by a gain that varies directly with D, where D is equal to the separation distance measured in meters.

10. The method of claim 5, further including a third path in parallel with the second path, the third path operating to substantially bypass the second path with the electrical signal, when the frequency of the electrical signal is above a predetermined frequency.

11. The method of claim 10, wherein the predetermined frequency is substantially 300 Hz.

12. The method of claim 10, wherein the predetermined frequency is with a range of 100 to 500 Hz.

13. The method of claim 1, further comprising the steps of:

receiving a user input, the user input being indicative of the separation distance;

controlling a degree of signal modification as a function of the received user input; and controlling a type of signal modification as a function of the received user input.

14. The method of claim 1, wherein the modifying of the electrical signal comprises:

filtering the electrical signal using a band pass filter, the band pass filter having a center frequency of approximately 86/D and a gain of approximately −6.2*D dB, where D is the separation distance measured in meters.

15. The method of claim 14, wherein the modifying of the electrical signal further comprises:

attenuating low-frequency components of the electrical signal by approximately (1.9*D)−5.1 dB for values of D less than approximately 2.7 meters, the low-frequency components being frequency components below approximately 100 Hz to 500 Hz.

16. An apparatus for improving a quality of sound from a speaker comprising:

receiving means for receiving an electrical signal embodying an audio signal to be communicated to the speaker; and modifying means for modifying the electrical signal by a measure that is based upon a separation distance separating the speaker and a wall, wherein the modifying means includes circuitry configured to modify by a transfer function that is substantially an inverse of a change in a frequency response of the speaker due to placement near the wall.

17. The apparatus of claim 16, further including means for obtaining the separation distance.

18. The apparatus of claim 17, wherein the means for obtaining the separation distance includes circuitry configured to automatically obtain the separation distance.

19. The apparatus of claim 17, wherein the means for obtaining the separation distance includes a user interface for receiving a manually input separation distance.

20. The apparatus of claim 16, wherein the modifying means includes circuitry defining two separate paths and having a summing mechanism configured to sum the output of the two separate paths to generate an output signal.

21. The apparatus of claim 20, wherein the first separate path includes a series arrangement of a first amplifier element defined by a gain of substantially −6.2*D, where D is equal to the separation distance measured in meters, and a bandpass filter having a center frequency substantially equal to 86/D.

22. The apparatus of claim 21, wherein bandpass filter is a second order bandpass filter.

23. The apparatus of claim 20, wherein the second separate path includes a second amplifier element defined by a gain of substantially 1.9*D−5.1 dB, where D is equal to the separation distance measured in meters.

24. The apparatus of claim 20, further including a third path disposed in parallel with the second path, the third path being configured to substantially bypass the second path with the electrical signal, when the frequency of the electrical signal is above a predetermined frequency.

25. The apparatus of claim 24, wherein the predetermined frequency is substantially 300 Hz.

26. The apparatus of claim 24, wherein the predetermined frequency is within a range of 100 to 500 Hz.

27. The apparatus of claim 16, further comprising:

means for receiving a user input, the user input being indicative of the separation distance;

means for controlling a degree of signal modification as a function of the received user input; and means for controlling a type of signal modification as a function of the received user input.

28. The apparatus of claim 16, further comprising:

means for filtering the electrical signal, the means for filtering having a center frequency of approximately 86/D and a gain of approximately −6.2*D dB, where D is the separation distance measured in meters.

29. The apparatus of claim 28, further comprising:

means for attenuating low-frequency components of the electrical signal by approximately (1.9*D)−5.1 dB for values of D less than approximately 2.7 meters, the low-frequency components being frequency components below approximately 100 Hz to 500 Hz.

30. A circuit configured to modify the electrical signal to a loudspeaker by a measure comprising:

a receiver circuit configured to receive an electrical signal embodying an audio signal to be communicated to the speaker;

a signal modifying circuit configured to modify the frequency response of the electrical signal by a measure that is based upon a separation distance separating the speaker and a wall; and a distance obtaining circuit configured to obtain the separation distance, wherein the distance obtaining circuit includes a user interface for receiving a separation distance measure that is manually entered.

31. A circuit configured to modify the electrical signal to a loudspeaker by a measure comprising:

a receiver circuit configured to receive an electrical signal embodying an audio signal to be communicated to the speaker; and a signal modifying circuit configured to modify the frequency response of the electrical signal by a measure that is based upon a separation distance separating the speaker and a wall, wherein the signal modifying circuit is configured to modify the electrical signal by a measure that is based upon multiple separation distances, including a first separation distance separating the speaker and a rear wall and a second separation distance separating the speaker and a side wall.

32. A circuit configured to modify the electrical signal to a loudspeaker by a measure comprising:

a receiver circuit configured to receive an electrical signal embodying an audio signal to be communicated to the speaker;

a signal modifying circuit configured to modify the frequency response of the electrical signal by a measure that is based upon a separation distance separating the speaker and a wall; and a circuit element configured to receive a user input, the user input being indicative of the separation distance; and a controller configured to control a degree of signal modification as a function of the received user input, the controller further being configured to control a type of signal modification as a function of the received user input.

33. A circuit configured to modify the electrical signal to a loudspeaker by a measure comprising:

a receiver circuit configured to receive an electrical signal embodying an audio signal to be communicated to the speaker; and a signal modifying circuit configured to modify the frequency response of the electrical signal by a measure that is based upon a separation distance separating the speaker and a wall, wherein the signal modifying circuit comprises a band pass filter having a center frequency of approximately 86/D and a gain of approximately −6.2*D dB, where D is the separation distance measured in meters.

34. A circuit configured to modify the electrical signal to a loudspeaker by a measure comprising:

a receiver circuit configured to receive an electrical signal embodying an audio signal to be communicated to the speaker; and a signal modifying circuit configured to modify the frequency response of the electrical signal by a measure that is based upon a separation distance separating the speaker and a wall, wherein the signal modifying circuit further comprises an attenuator configured to attenuate low-frequency components of the electrical signal by approximately (1.9*D)−5.1 dB for values of D less than approximately 2.7 meters, the low-frequency components being frequency components below approximately 100 Hz to 500 Hz.

* * * * *